US009976379B2

(12) United States Patent
Schmidt et al.

(10) Patent No.: US 9,976,379 B2
(45) Date of Patent: May 22, 2018

(54) WELLBORE ISOLATION DEVICE WITH SLIP ASSEMBLY

(71) Applicant: HALLIBURTON ENERGY SERVICES, INC., Houston, TX (US)

(72) Inventors: Daniel Lee Schmidt, Dallas, TX (US); Brian Keith Ogle, Duncan, OK (US); Matt Brian Roseman, Lancaster, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days. days.

(21) Appl. No.: 15/128,377

(22) PCT Filed: Sep. 22, 2015

(86) PCT No.: PCT/US2015/051465
§ 371 (c)(1),
(2) Date: Sep. 22, 2016

(87) PCT Pub. No.: WO2017/052510
PCT Pub. Date: Mar. 30, 2017

(65) Prior Publication Data
US 2017/0260825 A1 Sep. 14, 2017

(51) Int. Cl.
*E21B 33/12* (2006.01)
*E21B 33/129* (2006.01)
(Continued)

(52) U.S. Cl.
CPC ..... *E21B 33/12* (2013.01); *E21B 23/01* (2013.01); *E21B 23/06* (2013.01); *E21B 33/129* (2013.01)

(58) Field of Classification Search
CPC ..... E21B 23/01; E21B 33/12; E21B 33/129; E21B 33/134; E21B 33/16; E21B 33/1293; E21B 23/06; E21B 33/1208
See application file for complete search history.

(56) References Cited

U.S. PATENT DOCUMENTS 2,241,561 A * 5/1941 Spencer ..... E21B 33/128 166/134
3,006,416 A * 10/1961 Roach ..... E21B 23/01 166/209
(Continued)

FOREIGN PATENT DOCUMENTS

CA 2628164 A1 5/2007

OTHER PUBLICATIONS

Halliburton Completion Tools, Fas Drill Frac Plug, Service Tools, H06159, Jul. 2014.
(Continued)

*Primary Examiner* — Michael R Wills, III
(74) *Attorney, Agent, or Firm* — Polsinelli PC

(57) ABSTRACT

A wellbore isolation device comprising a tubular body comprising a downhole component having an external surface and a first inner bore formed therein, and an uphole component having a sloped external surface and a second inner bore formed therein, wherein the sloped external surface of the uphole component has at least one first protrusion, a plurality of slips disposed about the external surface of the tubular body between the uphole component and the downhole component, each of the plurality of slips comprising at least one sloped surface having at least one second protrusion, and an outer surface facing away from the external surface of the tubular body, the outer surface having one or more gripping protrusions, wherein the at least one sloped surface of each of the slip abuts the sloped external surface of the uphole component, wherein the three components provide a central inner bore.

21 Claims, 12 Drawing Sheets

(51) Int. Cl.
*E21B 23/01* (2006.01)
*E21B 23/06* (2006.01)

(56) References Cited

U.S. PATENT DOCUMENTS 3,412,803 A * 11/1968 Stachowiak ..... E21B 33/1293 166/134
3,623,551 A * 11/1971 Randermann, Jr. . E21B 33/1293 166/134
4,934,459 A * 6/1990 Baugh ..... E21B 23/01 166/380
5,101,897 A 4/1992 Leismer et al.
5,303,776 A * 4/1994 Ryan ..... E21B 23/06 166/147
5,984,007 A 11/1999 Yuan et al.
6,167,963 B1 1/2001 McMahan et al.
8,459,347 B2 * 6/2013 Stout ..... E21B 17/026 166/138
8,579,024 B2 * 11/2013 Mailand ..... E21B 33/129 166/118
8,950,504 B2 * 2/2015 Xu ..... E21B 23/01 166/237
9,080,403 B2 * 7/2015 Xu ..... E21B 23/01
2005/0257936 A1 11/2005 Lehr
2008/0191420 A1 * 8/2008 Imhoff ..... E21B 23/01 277/315
2008/0264627 A1 10/2008 Roberts et al.
2010/0263857 A1 10/2010 Frazier
2010/0916095 10/2010 Nish et al.
2011/0005779 A1 1/2011 Lembcke
2011/0088891 A1 * 4/2011 Stout ..... E21B 33/1204 166/120
2013/0186646 A1 * 7/2013 Xu ..... E21B 23/06 166/382
2014/0166317 A1 6/2014 Gregory
2014/0311752 A1 * 10/2014 Streich ..... E21B 33/1204 166/376
2015/0021012 A1 * 1/2015 Gerrard ..... E21B 23/00 166/237
2015/0090439 A1 4/2015 Vanlue
2015/0129215 A1 * 5/2015 Xu ..... C22C 1/0408 166/285
2015/0129239 A1 * 5/2015 Richard ..... E21B 23/06 166/377
2016/0138363 A1 * 5/2016 Sommers ..... E21B 23/06 166/387
2016/0186511 A1 * 6/2016 Coronado ..... E21B 33/128 166/381

OTHER PUBLICATIONS

International Search Report and Written Opinion; PCT Application No. PCT/US2015/051465; dated May 30, 2016.

* cited by examiner

WELLBORE ISOLATION DEVICE WITH SLIP ASSEMBLY

CROSS-REFERENCE TO RELATED APPLICATIONS

This application is a national stage entry of PCT/US2015/051465 filed Sep. 22, 2015, said application is expressly incorporated herein in its entirety.

FIELD

The present disclosure relates generally to wellbore isolation operations. In particular, the subject matter herein generally relates to a wellbore isolation device having a slip assembly.

BACKGROUND

Wellbores are drilled into the earth for a variety of purposes including accessing hydrocarbon bearing formations to extract hydrocarbons for use as fuel, lubricants, chemical production, and other purposes. In order to facilitate processes and operations in the wellbore, it may often be desirable to isolate or seal one or more portions of a wellbore. Zonal isolation within a wellbore may be provided by wellbore isolation devices, such as packers, bridge plugs, and fracturing plugs (i.e., "frac" plugs).

Wellbore isolation devices are set in the wellbore by a setting tool. For instance, the wellbore isolation device is run into the wellbore coupled to a setting tool, which is in turn coupled to a conveyance. When the wellbore isolation device is positioned at the desired depth in the wellbore, the setting tool causes the actuation of the slip and seal assemblies on the wellbore isolation device, thereby setting the wellbore isolation device against the wall of the wellbore.

Typical wellbore isolation devices have two sets of slips and a sealing assembly. When engaged, one set of slips prevents the wellbore isolation device from traveling downward, the second set of slips prevents the wellbore isolation device from traveling upward, and the sealing assembly holds the two sets of slips in tension so that they will not return to a resting position.

BRIEF DESCRIPTION OF THE DRAWINGS

Implementations of the present technology will now be described, by way of example only, with reference to the attached figures, wherein.

DETAILED DESCRIPTION

Figure 1:
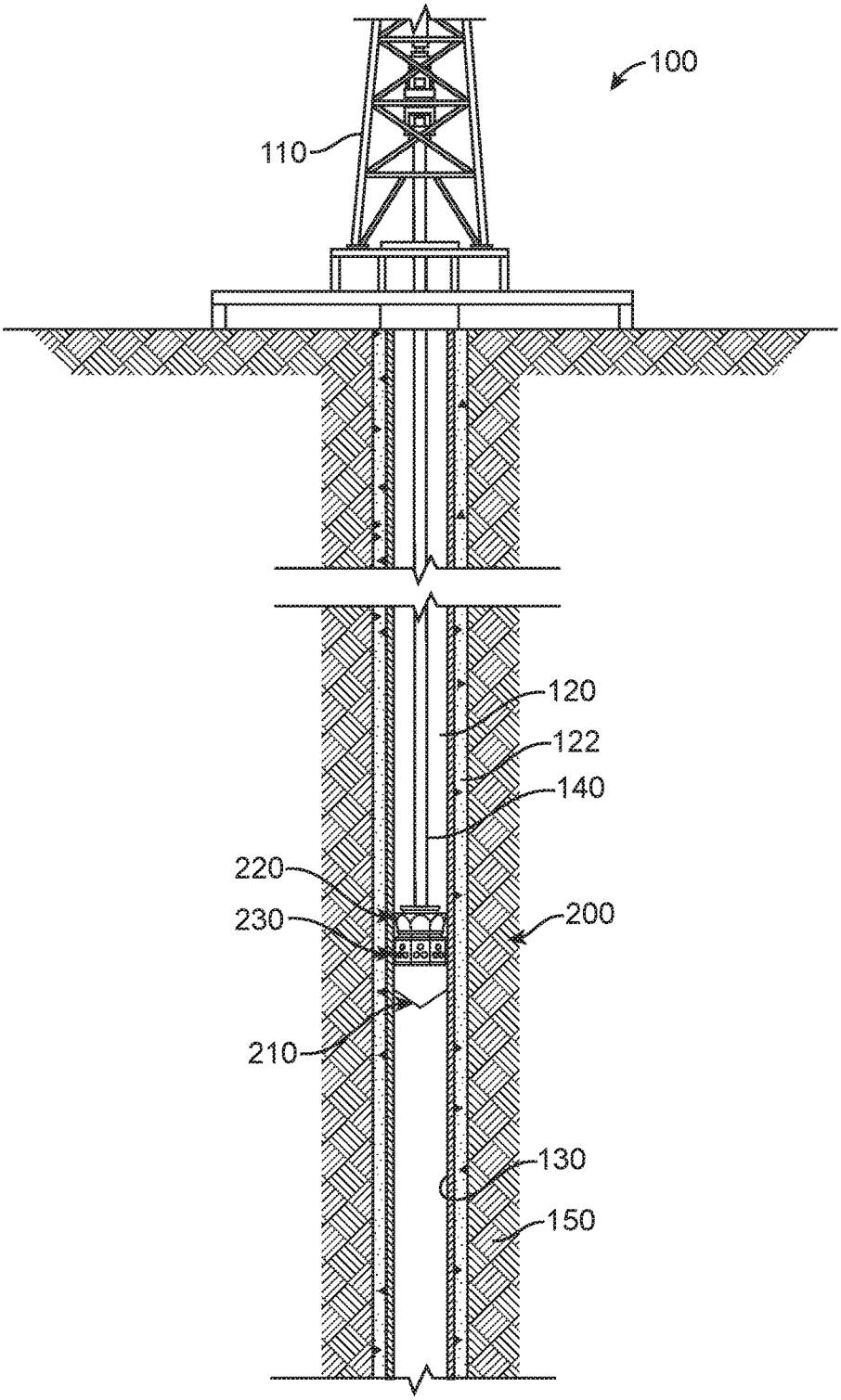
FIG. 1 is a diagram illustrating an exemplary environment for a wellbore isolation device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

Disclosed herein is a wellbore isolation device for use in isolating portions of a wellbore. The wellbore isolation device as disclosed herein includes a downhole component, an uphole component, and a plurality of slips collectively providing a central inner borehole. A setting tool proximate the tubular body, and in particular, disposed within the inner borehole of the wellbore isolation device can cause the slips to engage with the uphole component of the wellbore isolation device such that protrusions on the outside surface of the slips grip into the casing of the wellbore, fixing the wellbore isolation device into place. The bi-directional slip arrangement of the wellbore isolation device holds the slips in their engaged state, compressed against the casing, allowing for the removal of a conventional sealing assembly. The arrangement can also significantly decrease the size and components required in a wellbore isolation device.

The wellbore isolation device disclosed herein may be any of a variety of downhole tools, including, but not limited to, a frac plug, a packer, and a bridge plug.

A frac plug may include an elongated tubular body member with an axial flowbore extending therethrough, and a ball, which can act as a one-way check valve. The ball, when seated on an upper surface of the flowbore, acts to seal off the flowbore and prevent flow downwardly therethrough, but permits flow upwardly through the flowbore. Frac plugs may include a cage formed at the upper end of the tubular body member to retain the ball.

A packer generally includes a mandrel having an upper end, a lower end, and an inner surface defining a longitudinal central flow passage. More specifically, a packer element assembly can extend around the tubular body member; and include one or more slips mounted around the body member, above and below the packer assembly. The slips can be guided by mechanical slip bodies.

A bridge plug generally includes a plug mandrel, one or more slips, and a rubber sealing element and is typically used for zonal isolation within a wellbore. More specifically, a bridge plug is a mechanical device installed within a wellbore and used for blocking the flow of fluid from one part of the wellbore to another.

The setting tool disclosed herein may be any conventional setting tool. The most commonly used setting tools set the wellbore isolation device from the top by pulling the tubular body, or mandrel, of the wellbore isolation device in the uphole direction. The setting tool generates a large amount of force, often in excess of 20,000 lbs, producing significant tension on the tubular body of the wellbore isolation device. The tension in the tubular body of the wellbore isolation device, produced by the setting tool, causes the slips to radially extend against the wall of the wellbore or casing, thereby setting the wellbore isolation device and establishing a zonal isolation seal. Various types of setting tools exist. Some setting tools are activated by hydrostatic or hydraulic pressure. However, some of the most commonly used setting tools, such as the Model E-4 Wireline Pressure Setting Assembly (commercially available from Baker Hughes) and the "Shorty" (commercially available from Halliburton Energy Services), are explosive setting tools that are activated by means of a pyrotechnic or black powder charge.

The wellbore isolation device can be deployed in an exemplary wellbore system 100 shown, for example, in FIG. 1. A system 100 for wellbore isolation can include a drilling rig 110 extending over and around a wellbore 120. The wellbore 120 is drilled within an earth formation 150 and has a casing 130 lining the wellbore 120, the casing 130 is held into place by cement 122. A wellbore isolation device 200 can include a downhole component 210, an uphole component 220, and a plurality of slips 230. The wellbore isolation device 200 can be moved down the wellbore 120 via a conveyance 140 to a desired location. A conveyance can be, for example, tubing-conveyed, coiled tubing, joint tubing, or other tubulars, wireline, slickline, work string, or any other suitable means for conveying tools into a wellbore. Once the wellbore isolation device 200 reaches the desired location a setting tool (shown in FIG. 6) may be actuated to anchor the wellbore isolation device into place.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Figure 2A:
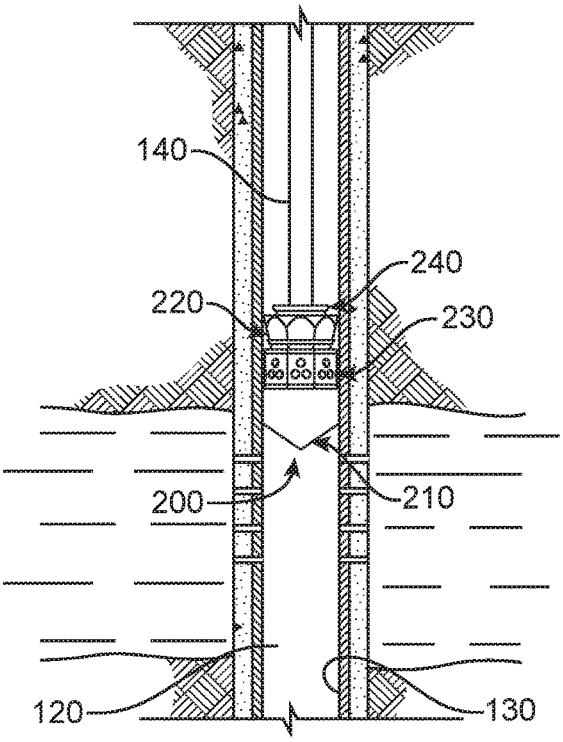
FIG. 2A is a diagram illustrating an exemplary environment for a first embodiment of a wellbore isolation device in a resting configuration.
Figure 2B:
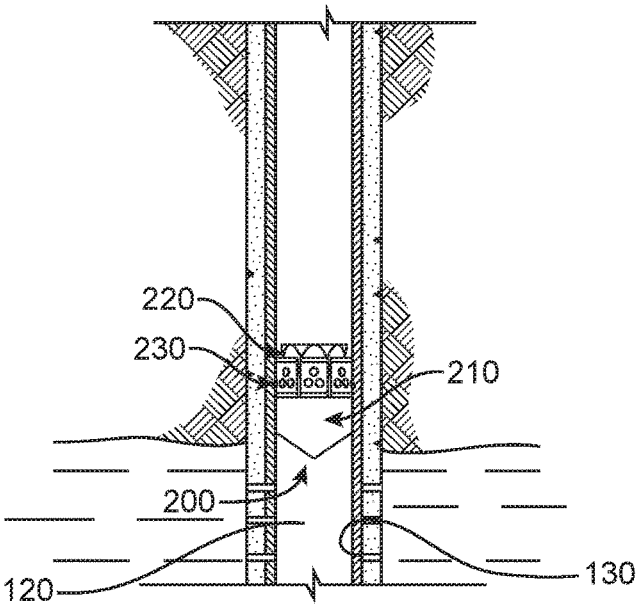
FIG. 2B is a diagram illustrating an exemplary environment for a first embodiment of a wellbore isolation device in an engaged configuration.

FIG. 2A depicts a first exemplary wellbore isolation device 200 in a resting configuration disposed within a wellbore 120. In the resting configuration, the wellbore isolation device 200 is coupled to a setting tool 240 and conveyance 140. The wellbore isolation device 200 is configured such that the wellbore isolation device 200 can be moved uphole or downhole without catching on the casing 130 of the wellbore 120. FIG. 2B illustrates the wellbore isolation device 200 of FIG. 2A in an engaged configuration, showing the wellbore isolation device 200 secured in place within the wellbore 120. In the engaged configuration, protrusions on the wellbore isolation device 200 grip onto the casing 130 lining the wellbore 120, such that the wellbore isolation device 200 is fixed into place.

Figure 3A:
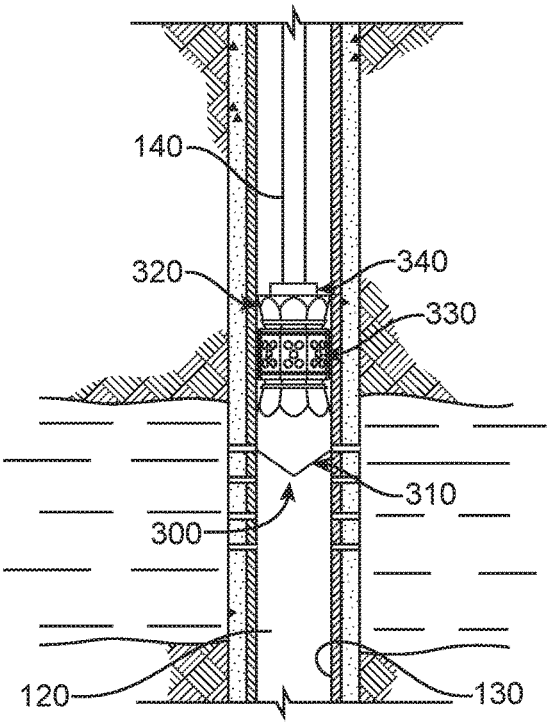
FIG. 3A is a diagram illustrating an exemplary environment for a second embodiment of a wellbore isolation device in a resting configuration.
Figure 3B:
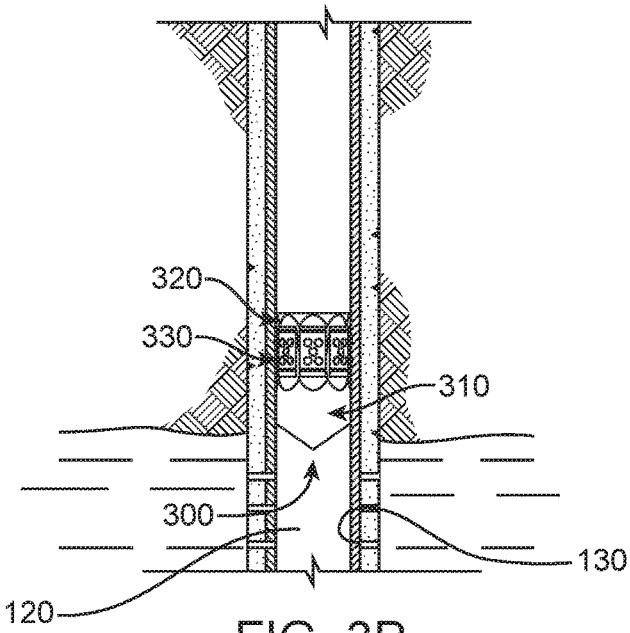
FIG. 3B is a diagram illustrating an exemplary environment for a second embodiment of a wellbore isolation device in an engaged configuration.

FIG. 3A depicts a second exemplary wellbore isolation device 300 in a resting configuration disposed within a wellbore 120. In the resting configuration the wellbore isolation device 300 is coupled to a setting tool 340 and conveyance 140. FIG. 3B illustrates the wellbore isolation device 300 of FIG. 3A in an engaged configuration. In the engaged configuration, protrusions on the wellbore isolation device 300 grip onto the casing 130 lining the wellbore 120, such that the wellbore isolation device 300 is fixed into place. Although FIGS. 2A-3B show setting within a casing 130, it will be understood the device can be set in any type of tubing.

Figure 4:
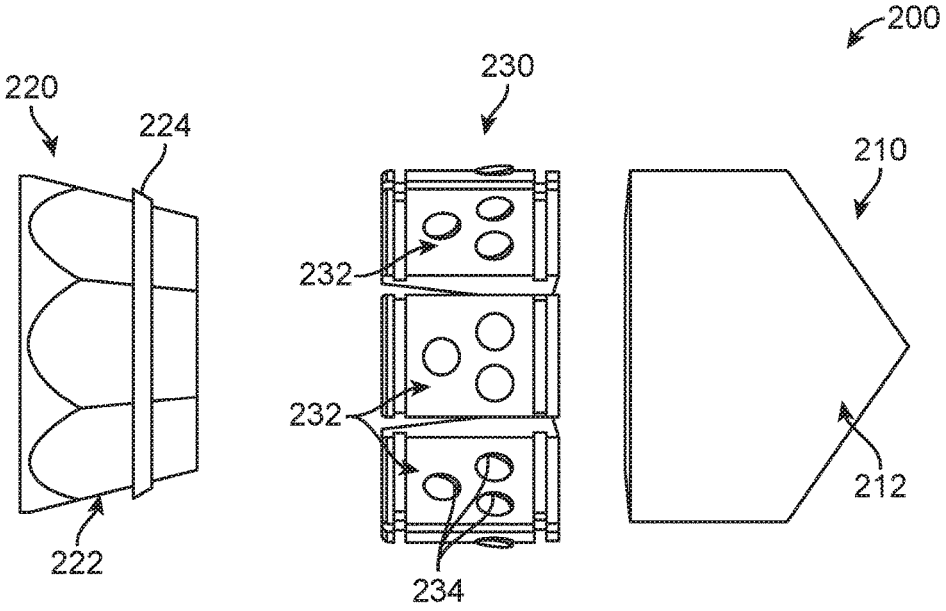
FIG. 4 is an exploded diagram of a first exemplary embodiment of a wellbore isolation device according to the present disclosure.
Figure 8:
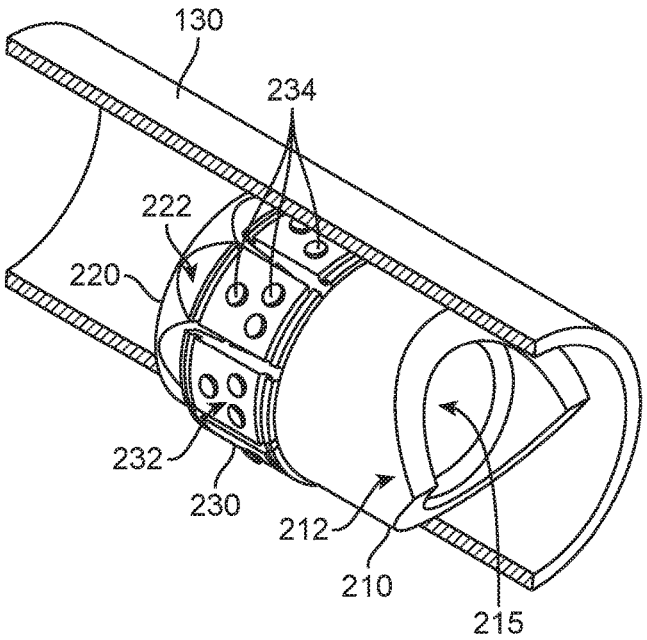
FIG. 8 is a perspective diagram of the exemplary wellbore isolation device in an engaged configuration within a wellbore according to the disclosure herein.

FIG. 4 illustrates an exploded view of a first example of a wellbore isolation device 200 that can be used in the exemplary wellbore system 100 of FIG. 1. The wellbore isolation device 200 can include a downhole component 210, an uphole component 220, and a plurality of slips 230. The downhole component 210, uphole component 220, and plurality of slips 230 collectively provide an inner borehole 215 (as shown in FIG. 8) throughout the tubular body having a central axis A-A. The inner borehole allows fluid to pass through the wellbore isolation device 200. The downhole component 210 can have a flat external surface, whereas the external surface 222 of the uphole component 220 is sloped. The sloped external surface 222 of the uphole component can have at least one first protrusion 224. The at least one first protrusion 224 can be a ratcheted protrusion, or a series of ratcheted protrusions, for example, a series of ratcheted teeth.

Figure 5:
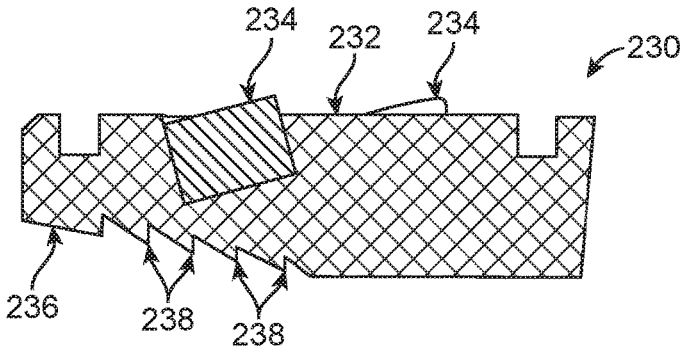
FIG. 5 is an enlarged, cross sectional view of a slip of the exemplary wellbore isolation device of FIG. 4.

A plurality of slips 230 is disposed around the external surface of the downhole and uphole components 210, 220. The plurality of slips 230 is configured such that when a force is applied to the inner surface of the slips, the slips will become radially displaced with respect to the central axis of the wellbore isolation device 200. The outer surface 232 of each of the plurality of slips 230 can have one or more gripping protrusions 234 capable of biting into the casing 130 of the wellbore 120. A cross-sectional view of one slip 230 is shown in FIG. 5. Each slip 230 can have an inner surface, at least a portion of which may be sloped towards the central axis of the wellbore isolation device 200 forming a sloped surface 236; the sloped surface 236 can have at least one second protrusion 238 (such as a plurality). The at least one second protrusion 238 can be a ratcheted protrusion, or series or plurality of ratcheted protrusions, for example, a series of ratcheted teeth. The protrusion(s) 238 can be arranged perpendicular to the direction of the casing or at an angle relative to the casing.

Figure 6:
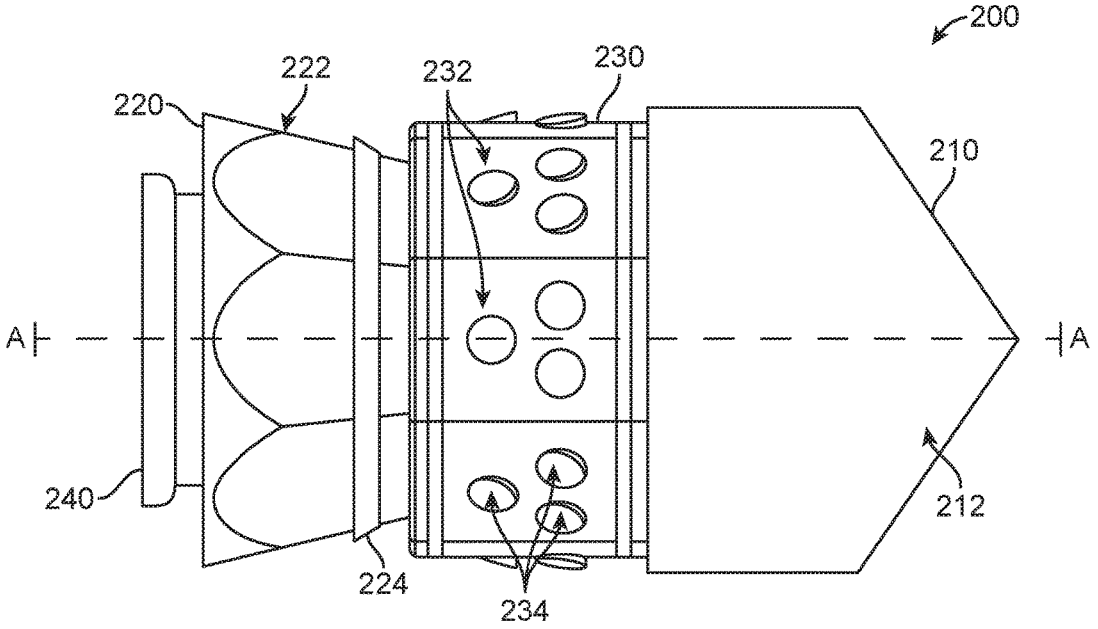
FIG. 6 is an assembled diagram of the first exemplary wellbore isolation device in a resting configuration according to the disclosure herein.
Figure 7:
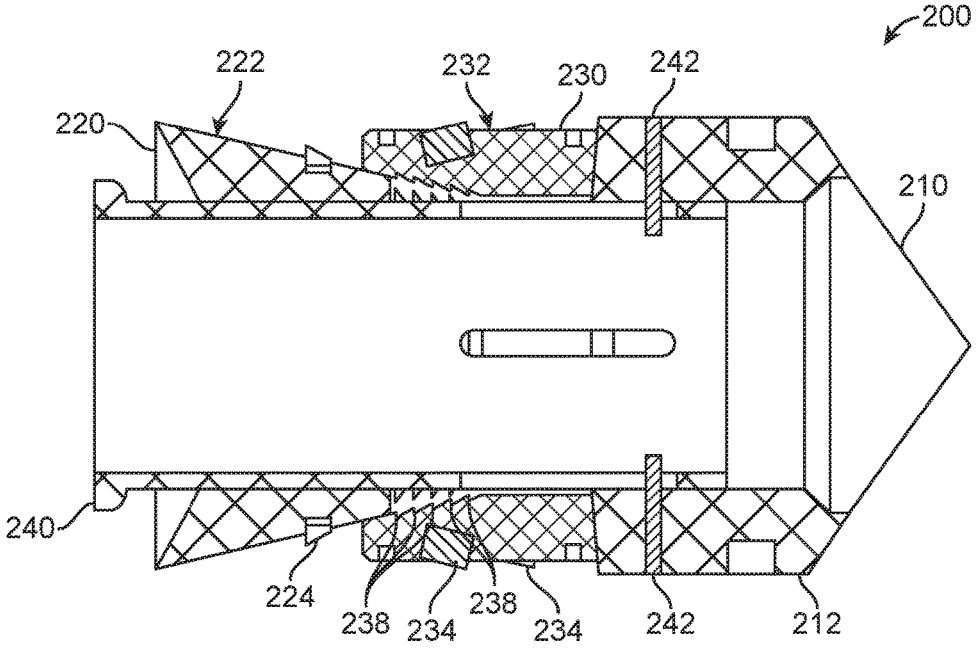
FIG. 7 is a cross sectional diagram of the first exemplary wellbore isolation device in a resting configuration taken along line A-A of FIG. 6.

FIG. 6 illustrates an assembled view of the wellbore isolation device 200 with a setting tool 240 disposed within the inner bore (as shown in FIG. 8) of the wellbore isolation device 200 in the resting configuration. In this configuration, a first end of each slip 230 can be coupled to a first end of the downhole component 210. The coupling between the slip 230 and the downhole component 210 can be a joint, a hinge, a flexible material, a pivot, or any other suitable coupling means. A cross-sectional view of the resting configuration of the wellbore isolation device 200 and setting tool 240 is shown in FIG. 7. As shown, the sloped surface 236 of each of the slips 230 rests against the sloped surface 222 of the uphole component 220 while in the resting configuration. The setting tool 240 can be coupled to the downhole component 210 via one or more shearing pins 242, or any other suitable coupling means. Alternatively, the setting tool can be a wedged setting tool, a collet style setting tool, shear pin setting tool, or any other suitable setting tool.

Figure 9:
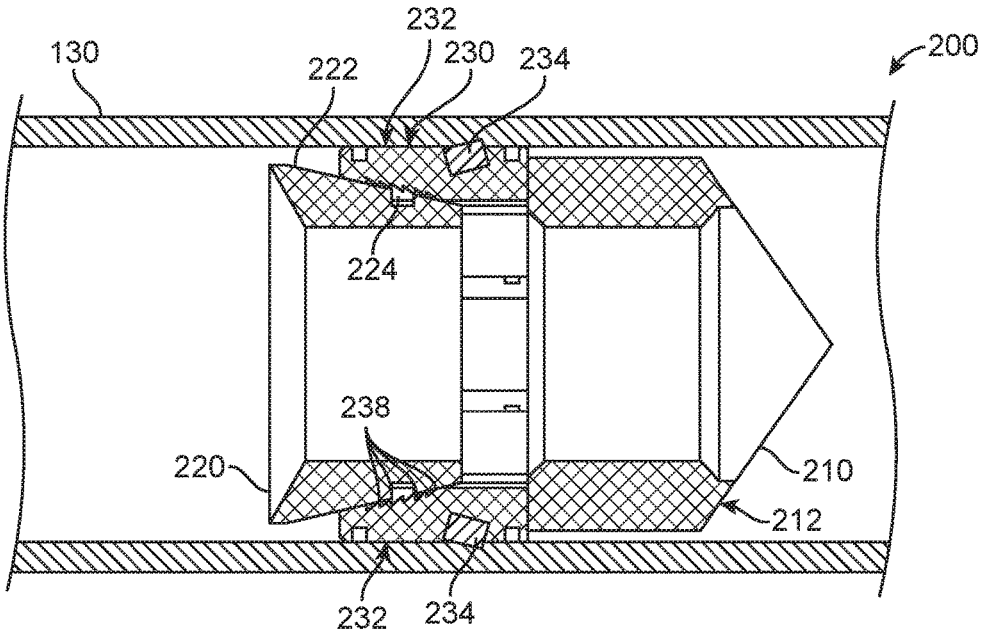
FIG. 9 is a cross sectional diagram of the first exemplary wellbore isolation device in an engaged configuration of FIG. 8.

FIG. 8 shows a perspective view of the wellbore isolation device 200 in an engaged configuration and partially surrounded by the casing 130 of the wellbore 120 (shown in FIG. 1). To transition to the engaged configuration, the setting tool 240, disposed within the inner bore hole 215 of the wellbore isolation device 200, is pulled uphole, pulling the downhole component 210 upward until a maximum tension is reached and the shearing pins shear and release the setting tool. As the wellbore isolation device 200 transitions to the engaged configuration, the sloped surface 236 of the plurality of slips 230 engages the sloped surface 222 of the uphole component 220 which acts to radially deform the plurality of slips 230. The protrusion(s) 224 on the sloped outer surface 222 of the uphole component 220 mates with the protrusion(s) 238 of the sloped surface 236 of the slips 230 such that the two devices are secured together. The protrusions 224, 238 can both be ramped shaped with the ramped surfaces of protrusion(s) 224 being arranged complementary to the ramped surfaces of protrusion(s) 238, thus permitting sliding over one another in one direction (when transitioning to the engaged configuration) while catching and locking against one another in the reverse direction, thereby preventing the slips from relaxing back into the resting configuration and losing their grip on the casing. A cross sectional view of the engaged configuration is shown in FIG. 9, illustrating that when the uphole component 220 displaces the plurality of slips 230 the griping protrusion(s) 234 on the outer surface 232 of the plurality of slips 230 can grip the casing 130 lining the wellbore 120, such that the wellbore isolation device 200 is anchored into place. FIG. 9 also shows the interaction between the protrusions 224, 238.

Figure 10:
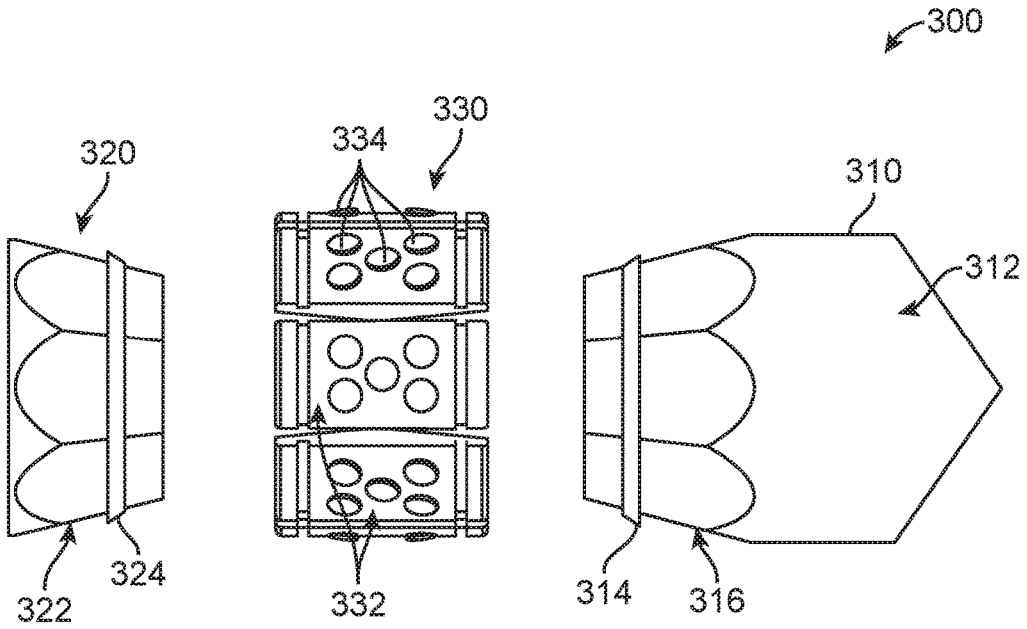
FIG. 10 is an exploded diagram of a second exemplary embodiment of a wellbore isolation device according to the present disclosure.
Figure 14:
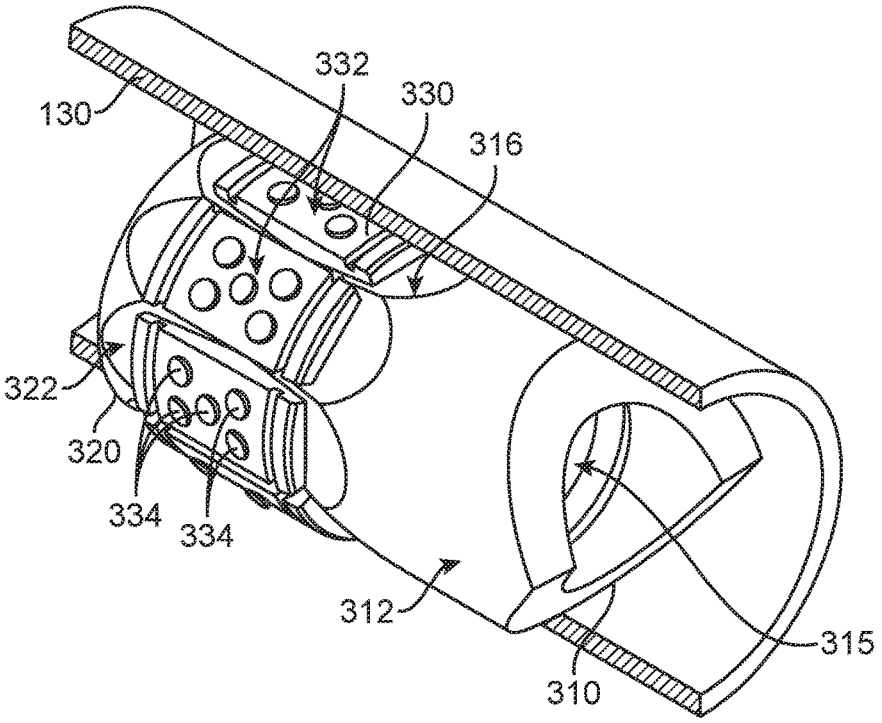
FIG. 14 is a perspective diagram of the second exemplary wellbore isolation device in an engaged configuration within a wellbore according to the disclosure herein.

FIG. 10 depicts an exploded view of a second example of a wellbore isolation device 300, wherein the wellbore isolation device 300 includes a downhole component 310, an uphole component 320, and a plurality of slips 330. The downhole component 310, uphole component 320, and plurality of slips 330 collectively provide an inner borehole 315 (as shown in FIG. 14) throughout the tubular body having a central axis B-B. The inner borehole allows fluid to pass through the wellbore isolation device 300. Both the downhole component 310 and the uphole component 320 can have a sloped external surface 316, 322, respectively. The sloped external surface 316 of the downhole component 310 can include at least one first protrusion 314. Similarly, the sloped external surface 322 of the uphole component 320 can have at least one first protrusion 324. The protrusions 314, 324 can be ratcheted protrusions, or a series of ratcheted protrusions, for example, a series of ratcheted teeth.

Figure 11:
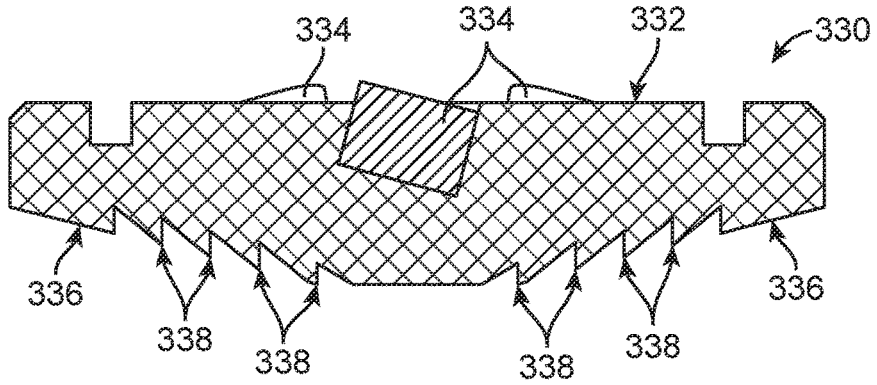
FIG. 11 is an enlarged, cross-sectional view of a slip of the exemplary wellbore isolation device of FIG. 10.

A plurality of slips 330 is disposed around the external surface of the downhole and uphole components 310, 320. The plurality of slips 330 is configured such that when a force is applied to the inner surface of each of the slips 330, the slips 330 will become radially displaced with respect to the central axis of the wellbore isolation device 300. The outer surface 332 of each of the plurality of slips 330 can have one or more gripping protrusions 334 capable of biting into the casing 130 of the wellbore 120. A cross-sectional view of one of the slips 330 is shown in FIG. 11. Each slip 330 can have an inner surface with two sloped surfaces 336, each of which slope towards the central axis of the wellbore isolation device 300. The sloped surfaces 336 can have at least one second protrusion 338 (such as a plurality). The at least one second protrusion 338 can be a ratcheted protrusion, or series of ratcheted protrusions, for example, a series of ratcheted teeth. The protrusion(s) 338 can be arranged perpendicular to the direction of the casing or at an angle relative to the casing.

Figure 12:
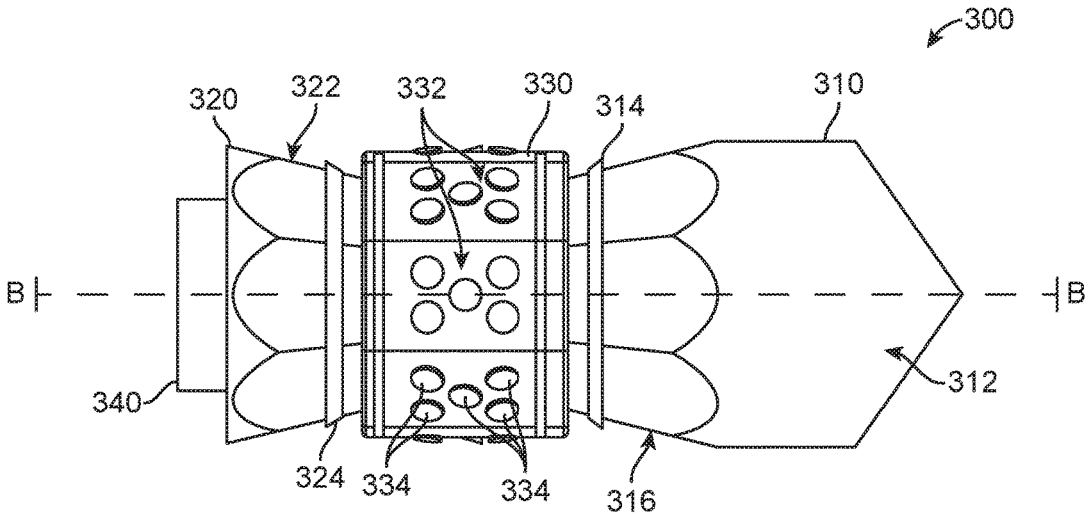
FIG. 12 is an assembled, diagram of the second exemplary wellbore isolation device in a resting configuration according to the disclosure herein.
Figure 13:
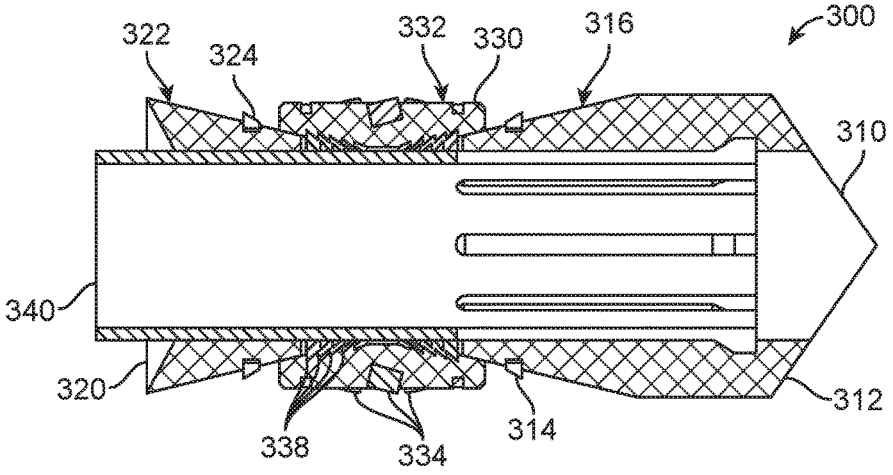
FIG. 13 is a cross sectional diagram of the second exemplary wellbore isolation device in a resting configuration taken along line B-B of FIG. 12.

FIG. 12 illustrates an assembled view of the wellbore isolation device 300 in a resting configuration with a setting tool 340 disposed within the wellbore isolation device 300. A cross-sectional view of the resting configuration of the wellbore isolation device 300 and setting tool 340 is shown in FIG. 13. As shown, the sloped surfaces 336 of each of the plurality of slips 330 rest against the sloped surfaces 316, 322 of the downhole and uphole components 310, 320, respectively. The setting tool 340 can be a collet style setting tool, secured within the downhole component 310 via wedge-shaped protrusions, or any other suitable setting tool as described above.

Figure 15:
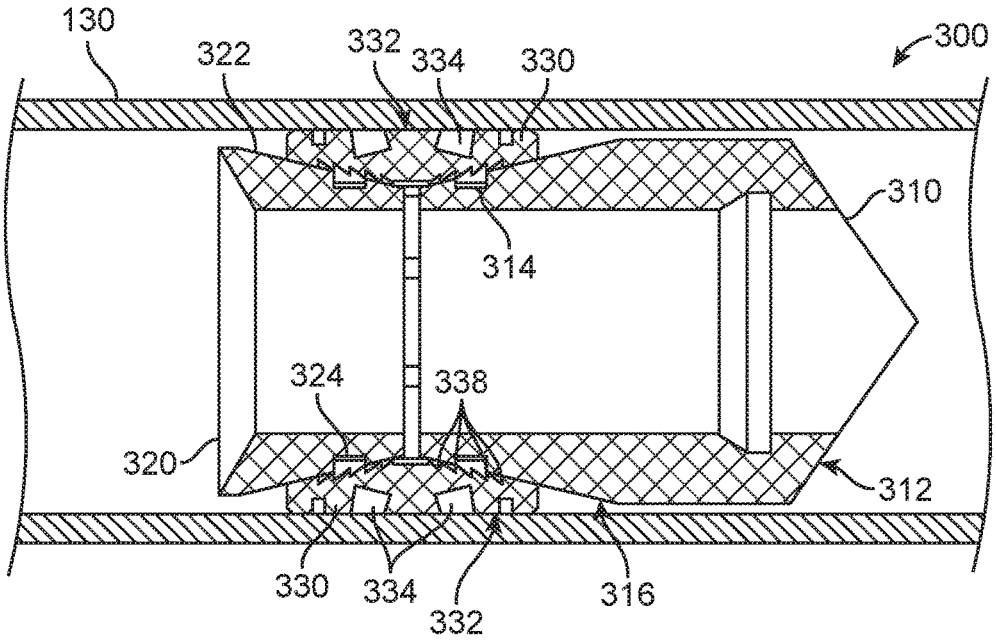
FIG. 15 is a cross sectional diagram of the second exemplary wellbore isolation device in an engaged configuration of FIG. 14.

FIG. 14 illustrates the engaged configuration of wellbore isolation device 300 partially surrounded by the casing 130 of a wellbore 120. The wellbore isolation device 300 can be run down the wellbore 120 while disposed on a setting tool 340, the setting tool 340 running through the inner bore hole 315 of the wellbore isolation device 300. When the wellbore isolation device 300 reaches the desired location, the setting tool 340 is actuated. The setting tool 340 can force the slips 330 radially outward such that the sloped surfaces 336 of the slips 330 fully engage the sloped surfaces 316, 322 of the downhole and uphole components, respectively. The protrusions 314, 324 on the sloped outer surfaces 316, 322 of the downhole and uphole components 310, 320, respectively, mate with the protrusions 338 of the sloped surfaces 336 of each of the slips 330 such that the two devices are secured together. As described above, the protrusions 314, 324, 338 can be ramped shaped with the ramped surfaces of protrusions 314, 324 being arranged complementary to the ramped surfaces of protrusions 338. Thus permitting the protrusions to slide over one another in one direction (when transitioning to the engaged configuration) while catching and locking against one another in the reverse direction, thereby preventing the slips from relaxing back into the resting configuration and losing their grip on the casing. A cross sectional view of the engaged configuration of the wellbore isolation device 300 is shown in FIG. 15, showing the interaction between the protrusions 314, 324, 338. FIG. 15 also shows that when the downhole and uphole components 310, 320 displace the plurality of slips 330, the griping protrusion(s) 334 on the outer surface 332 of each of the slips 330 grip the casing 130 lining the wellbore 120, such that the wellbore isolation device 300 is anchored into place, without requiring a sealing assembly.

Figure 16A:
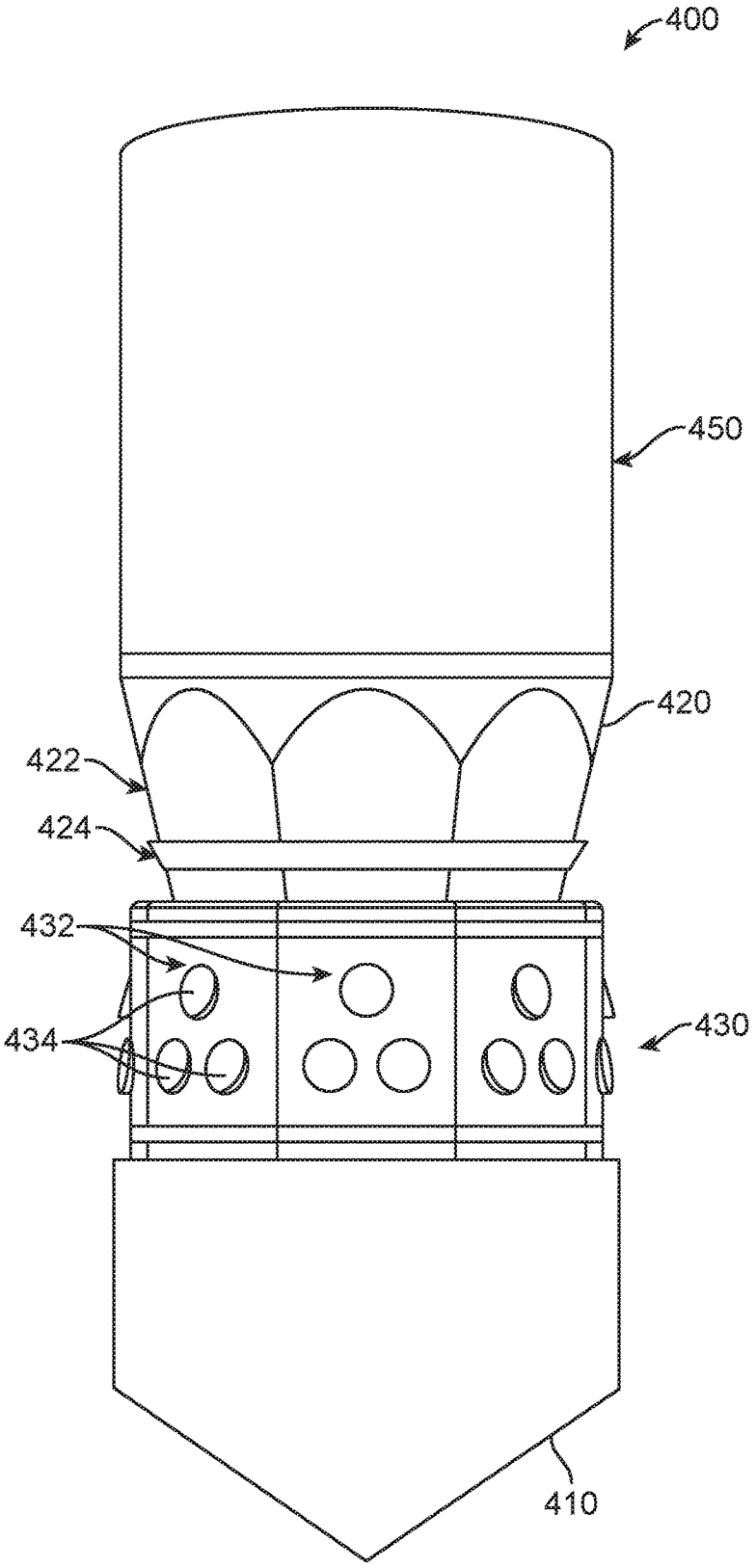
FIG. 16A is a diagrammatic view of a third exemplary wellbore isolation device having a sealing assembly according to the disclosure herein.

An elastic sealing assembly can be provided, such as a ball-seat sealing assembly, as shown in FIG. 16A. For example, a wellbore isolation device 400 can include a downhole component 410, an uphole component 420, a plurality of slips 430, and a sealing sleeve 450 coupled to the uphole component 420. The wellbore isolation device 400 can be anchored into place when a setting tool is actuated, urging the slips 430 over the sloped surface 422 of the uphole component 420, and engaging at least on protrusion 424 on the uphole component 420 with a protrusion(s) on the inside surface of each of the slips 430 and driving one or more gripping protrusions 434 on the outer surface 432 of each of the slips 330 into a casing. A ball can be pumped down the wellbore 120 after the wellbore isolation device 400 has been fixed into place. As the ball is seated it can deform the walls of the sealing sleeve 450 radially away from the central axis of the wellbore isolation device 400. Once seated, the ball can block the uphole end of the inner borehole, substantially blocking fluid communication through the wellbore isolation device 400. The walls of the sealing sleeve 450 can be elastically or plastically deformable and can be composed of any suitable elastically or plastically deformable material including, but not limited to, elastomers (including but not limited to rubber), polymers (including but not limited to plastics), or metal. One of ordinary skill in the art will understand that the material selected and the deformable nature (elastic or plastic) is an understood design choice generally dictated by the application of the system and method described herein.

Figure 16B:
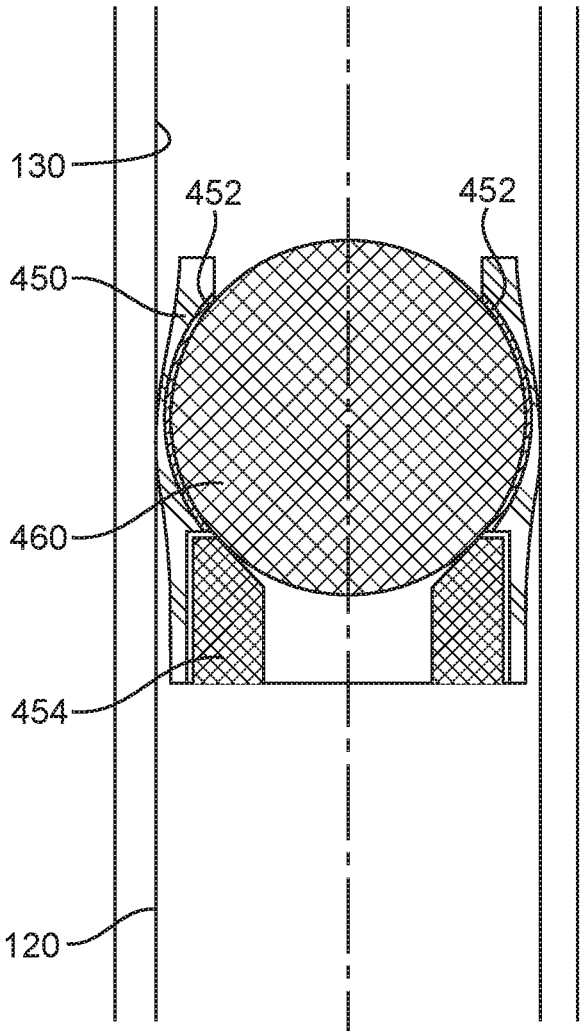
FIG. 16B is a cross sectional diagram of a portion of the sealing assembly of FIG. 16A.

FIG. 16B is a cross sectional view of the sealing assembly coupled to the uphole component 420 of wellbore isolation device 400 when ball 460 has been seated. Fluid communication through the inner borehole of the wellbore isolation device 400 is substantially blocked when ball 460 is seated and in contact with one or more baffles 454 located inside the sealing sleeve 450 and above the uphole component 420. If the walls of sealing sleeve 450 are deformable such that the sealing sleeve 450 contacts an external surface, such as a casing 130 inside a wellbore 120, fluid communication around wellbore isolation device 400 will be decreased or prevented. Plastically deformable layer 452 can be placed on the inner surface of the walls of sealing sleeve 450, such that when the ball 460 is being seated, the walls of sealing sleeve 450 are elastically deformed and plastically deformable layer 452 is plastically deformed. After deformation, plastically deformable layer 452 will maintain the deformation, holding the elastically deformed wall of sealing sleeve 450 in place. One of ordinary skill in the art will understand that the choice of materials for plastically deformable layer 452 is a design choice largely governed by application.

Figure 17:
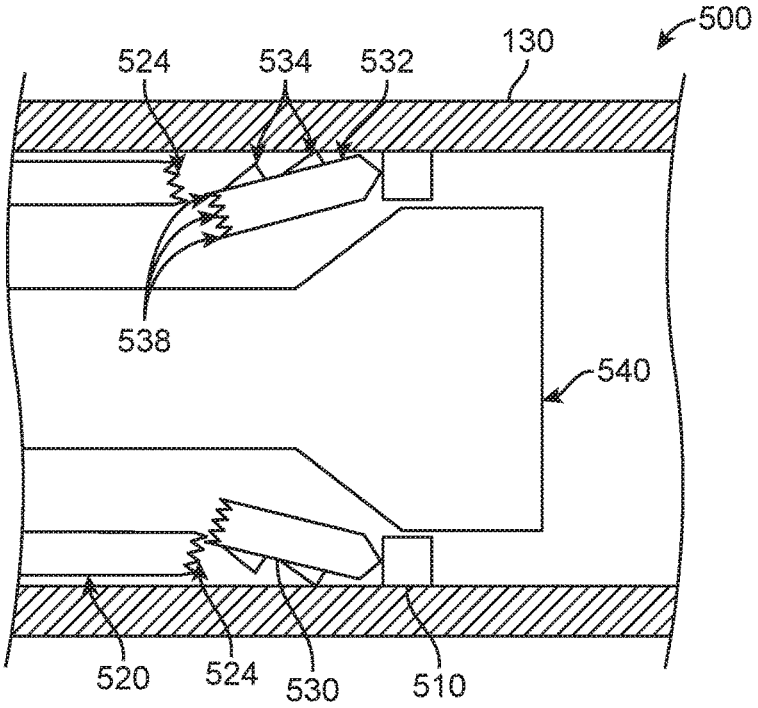
FIG. 17 is a cross sectional diagram of a fourth exemplary wellbore isolation device in a resting configuration.

FIG. 17 illustrates a fourth example of a wellbore isolation device 500 that can be used in the exemplary wellbore system 100 of FIG. 1, partially surrounded by a casing 130. The wellbore isolation device 500 can include a downhole component 510, an uphole component 520, and a plurality of slips 530. The downhole component 510, uphole component 520, and plurality of slips 530 collectively create an inner borehole throughout the tubular body having a central axis and which allows fluid to pass through the wellbore isolation device 500.

The uphole component 520 can have a sloped external surface having at least one first protrusion 524. A plurality of slips 530 is disposed around the external surface of the downhole and uphole components 510, 520. The outer surface 532 of each of the plurality of slips 530 can have one or more gripping protrusions 534 capable of biting into the casing 130 of a wellbore. A first end of each of the plurality of slips 530 can be coupled to a first end of the downhole component 510. A second end of each of the plurality of slips 530 can be sloped, the sloped surface having at least one second protrusion 538. The plurality of slips 530 is configured such that when a force is applied to the inner surface of the slips, the slips will become radially displaced with respect to the central axis of the wellbore isolation device 500. The force can be applied, for example, via wedged setting tool 540, or any other suitable setting tool. The protrusions 524, 538 can both be ramped shaped with the ramped surfaces of protrusion(s) 524 being arranged complementary to the ramped surfaces of protrusion(s) 538, thus permitting sliding over one another in one direction (when transitioning to the engaged configuration) while catching and locking against one another in the reverse direction, thereby preventing the slips from relaxing back into the resting configuration and losing their grip on the casing 130.

Figure 18:
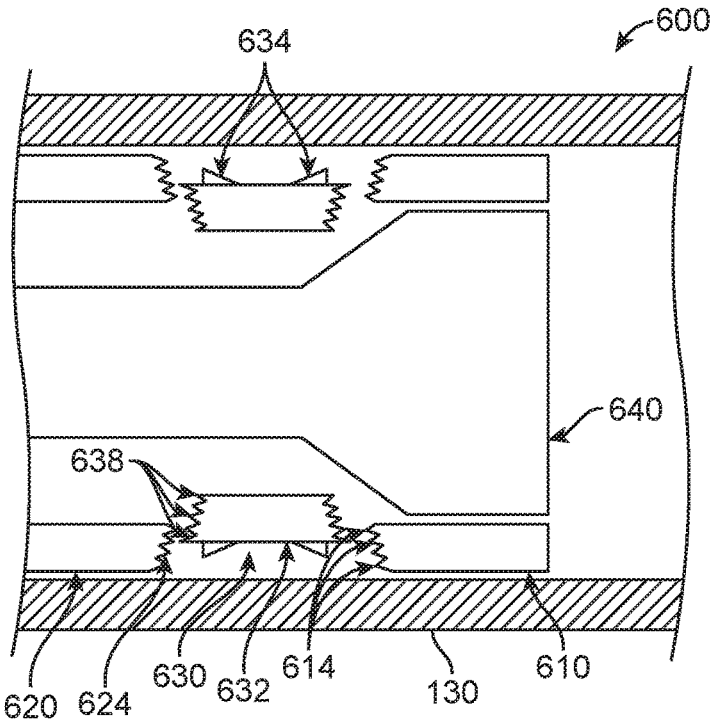
FIG. 18 is a cross sectional diagram of a fifth exemplary wellbore isolation device in a resting configuration.

Alternatively, FIG. 18 illustrates a fifth example of a wellbore isolation device 600 that can be used in the exemplary wellbore system 100 of FIG. 1, partially surrounded by a casing 130. The wellbore isolation device 600 can include a downhole component 610, an uphole component 620, and a plurality of slips 630. The downhole component 610, uphole component 620, and plurality of slips 630 collectively create an inner borehole throughout the tubular body having a central axis which allows fluid to pass through the wellbore isolation device 600.

The downhole and uphole components 610, 620 can have a sloped external surface having at least one first protrusion 614, 624, respectively. A plurality of slips 630 is disposed around the external surface of the downhole and uphole components 610, 620. The outer surface 632 of each of the plurality of slips 630 can have one or more gripping protrusions 634 capable of biting into the casing 130 of a wellbore. A first end and a second end of each of the plurality of slips 630 can be sloped, each of the sloped surfaces having at least one second protrusion 638. The plurality of slips 630 is configured such that when a force is applied to the inner surface of the slips, the slips will become radially displaced with respect to the central axis of the wellbore isolation device 600. The force can be applied, for example, via wedged setting tool 640, or any other suitable setting tool. The protrusions 614, 624, 638 can be ramped shaped with the ramped surfaces of protrusions 614, 624 being arranged complementary to the ramped surfaces of protrusion(s) 638, thus permitting sliding over one another in one direction (when transitioning to the engaged configuration) while catching and locking against one another in the reverse direction, thereby preventing the slips from relaxing back into the resting configuration and losing their grip on the casing 130.

Numerous examples are provided herein to enhance understanding of the present disclosure. A specific set of statements are provided as follows.

Statement 1: A wellbore isolation device comprising a tubular body comprising a downhole component having an external surface and a first inner bore formed therein, and an uphole component having a sloped external surface and a second inner bore formed therein, wherein the sloped external surface of the uphole component has at least one first protrusion, a plurality of slips disposed about the external surface of the tubular body between the uphole component and the downhole component, each of the plurality of slips comprising a sloped surface having at least one second protrusion, and an outer surface facing away from the external surface of the tubular body, the outer surface having one or more gripping protrusions, wherein the sloped surface of each of the slips abuts the sloped external surface of the uphole component.

Statement 2: A wellbore isolation device is disclosed according to Statement 1, wherein the downhole component, uphole component, and plurality of slips collectively provide a central inner bore having a central axis.

Statement 3: A wellbore isolation device is disclosed according to Statement 1 or Statement 2, wherein the at least one first protrusion is complementary to the at least one second protrusion.

Statement 4: A wellbore isolation device is disclosed according to Statements 1-3, wherein the at least one first protrusion and the at least one second protrusion are ratcheted protrusions.

Statement 5: A wellbore isolation device is disclosed according to Statements 1-4, wherein the sloped external surface of the uphole component is engageable with the sloped surface of at least one of the plurality of slips, and upon said engagement, the at least one first protrusion engages the at least one second protrusion and the plurality of slips shifts radially outward away from the central axis.

Statement 6: A wellbore isolation device is disclosed according to Statements 1-5, wherein the tubular body is one of a fracturing plug, a bridge plug, and a packer.

Statement 7: A wellbore isolation device is disclosed according to Statements 1-6, wherein a first end of each of the slips is coupled to a first end of the downhole component of the tubular body.

Statement 8: A wellbore isolation device is disclosed according to Statements 1-7, wherein a first end of the external surface of the downhole component is sloped, the sloped surface of the downhole component having at least one first protrusion.

Statement 9: A wellbore isolation device is disclosed according to Statements 1-8, wherein each of the slips has a second sloped surface, each of the sloped surfaces having at least one second protrusion.

Statement 10: A wellbore isolation device is disclosed according to Statements 1-9, wherein the uphole component further comprises a sealing mechanism comprising a sleeve extending from a first end of the uphole component and shaped to seat a ball, the sleeve having radially deformable walls; and wherein the sleeve is shaped such that seating the ball substantially blocks fluid communication through the tubular body, and such that the ball radially deforms the walls during the seating.

Statement 11: A wellbore isolation device is disclosed according to Statements 1-10, wherein the sleeve walls are shaped such that deformation of the walls causes the walls to contact a wellbore surface when residing in a wellbore.

Statement 12: A wellbore isolation device is disclosed according to Statements 1-11, wherein the sleeve walls are elastically deformable.

Statement 13: A wellbore isolation device is disclosed according to Statements 1-12, wherein the sleeve walls comprise an elastomer or polymer.

Statement 14: A method comprising running a wellbore isolation device and a setting tool into a wellbore to a predetermined depth, wherein the wellbore isolation device comprises a tubular body comprising a downhole component having an external surface and a first inner bore formed therein, and an uphole component having a sloped external surface and a second inner bore formed therein, wherein the sloped external surface of the uphole component has at least one first protrusion; and a plurality of slips disposed about the external surface of the tubular body between the uphole component and the downhole component, each of the plurality of slips comprising a sloped surface having at least one second protrusion, and an outer surface facing away from the external surface of the tubular body, the outer surface having one or more gripping protrusions, wherein the sloped surface of each of the slips abuts the sloped surface of the uphole component; and wherein the setting tool is proximate to the tubular body; actuating the setting tool to urge the sloped surface of each of the slip onto the sloped external surface of the uphole component, engaging the at least one first protrusion with the at least one second protrusion, and engaging the one or more gripping protrusions on the outer surface of each of the plurality of slips with an external surface.

Statement 15: A method is disclosed according to Statement 14, wherein the downhole component, uphole component, and plurality of slips collectively provide a central inner bore.

Statement 16: A method is disclosed according to Statement 14 or Statement 15, wherein the setting tool is disposed within the inner bore of the tubular body.

Statement 17: A method is disclosed according to Statements 14-16, wherein at least one first protrusion is complementary to the at least one second protrusion.

Statement 18: A method is disclosed according to Statements 14-17, wherein the at least one first protrusion and the at least one second protrusion are ratcheted protrusions.

Statement 19: A method is disclosed according to Statements 14-18, wherein the tubular body is one of a fracturing plug, a bridge plug, and a packer.

Statement 20: A method is disclosed according to Statements 14-19, wherein a first end of each of the slips is coupled to a first end of the downhole component of the tubular body.

Statement 21: A method is disclosed according to Statements 14-20, wherein a first end of the external surface of the downhole component is sloped, the sloped external surface of the downhole component having at least one first protrusion.

Statement 22: A method is disclosed according to Statements 14-21, wherein each of the slips has a second sloped surface, each of the sloped surfaces having at least one second protrusion.

Statement 23: A method is disclosed according to Statements 14-22, wherein the uphole component further comprises a sealing mechanism comprising a sleeve extending from a first end of the uphole component and shaped to seat a ball, the sleeve having radially deformable walls; and wherein the sleeve is shaped such that seating the ball substantially blocks fluid communication through the tubular body, and such that the ball radially deforms the walls during the seating.

Statement 24: A method is disclosed according to Statements 14-23, wherein the sleeve walls are shaped such that the deformation of the walls causes the walls to contact a wellbore surface when residing in the wellbore.

Statement 25: A method is disclosed according to Statements 14-24, wherein the sleeve walls are elastically deformable.

Statement 26: A method is disclosed according to Statements 14-25, wherein the sleeve walls comprise an elastomer or polymer.

Statement 27: A system comprising a wellbore isolation device disposed in a wellbore, the wellbore isolation device comprising a tubular body comprising a downhole component having an external surface and a first inner bore formed therein, and an uphole component having a sloped external surface and a second inner bore formed therein, wherein the sloped external surface of the uphole component has at least one first protrusion; and a plurality of slips disposed about the external surface of the tubular body between the uphole component and the downhole component, each of the plurality of slips assembly comprising a sloped surface having at least one second protrusion, and an outer surface facing away from the external surface of the tubular body, the outer surface having one or more gripping protrusions, wherein the sloped surface of each of the slips abuts the sloped external surface of the uphole component; and a setting tool proximate to the tubular body of the wellbore isolation device.

Statement 28: A system is disclosed according to Statement 27, wherein the downhole component, uphole component, and plurality of slips collectively provide a central inner bore.

Statement 29: A system is disclosed according to Statement 27 or Statement 28, wherein the at least one first protrusion is complementary to the at least one second protrusion.

Statement 30: A system is disclosed according to Statements 27-29, wherein the at least one first protrusion and the at least one second protrusion are ratcheted protrusions.

Statement 31: A system is disclosed according to Statements 27-30, wherein the sloped external surface of the uphole component is engageable with the sloped surface of at least one of the plurality of slips, and upon said engagement, the at least one first protrusion engages the at least one second protrusion and the plurality of slips shifts radially outward away from the central axis.

Statement 32: A system is disclosed according to Statements 27-31, wherein the tubular body is one of a fracturing plug, a bridge plug, and a packer.

Statement 33: A system is disclosed according to Statements 27-32, wherein a first end of each of the slips is coupled to a first end of the downhole component of the tubular body.

Statement 34: A system is disclosed according to Statements 27-33, wherein a first end of the external surface of the downhole component is sloped, the sloped external surface of the downhole component having at least one first protrusion.

Statement 35: A system is disclosed according to Statements 27-34, wherein each of the slips has a second sloped surface, each of the sloped surfaces having at least one second protrusion.

Statement 36: A system is disclosed according to Statements 27-35, wherein the uphole component further comprises a sealing mechanism comprising a sleeve extending from a first end of the uphole component and shaped to seat a ball, the sleeve having radially deformable walls; and wherein the sleeve is shaped such that seating the ball substantially blocks fluid communication through the tubular body, and such that the ball radially deforms the walls during the seating.

Statement 37: A system is disclosed according to Statements 27-36, wherein the sleeve walls are shaped such that the deformation of the walls causes the walls to contact a wellbore surface when residing in the wellbore.

Statement 38: A system is disclosed according to Statements 27-37, wherein the sleeve walls are elastically deformable.

Statement 39: A system is disclosed according to Statements 27-38, wherein the sleeve walls comprise an elastomer or polymer.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore isolation device comprising a tubular body comprising: a downhole component having an external surface and having a first inner bore formed therethrough, and an uphole component having a sloped external surface and having a second inner bore formed therethrough, wherein the sloped external surface of the uphole component has at least one first protrusion; a plurality of slips disposed about the external surface of the tubular body between the uphole component and the downhole component, each of the plurality of slips having a first end and a second end and comprising: an inner surface being sloped from the center of each of the plurality of slips to the second end of each of the plurality of slips providing a first sloped surface having at least one second protrusion, and an outer surface facing away from the external surface of the tubular body, the outer surface having one or more gripping protrusions, wherein the uphole component and the downhole component are separated by at least a portion of each of the plurality of slips, such that the first sloped surface of each of the slips abuts the sloped external surface of the uphole component and the first end of each of the plurality of slips abuts the downhole component, and wherein, when engaged, the downhole component, the uphole component, and the plurality of slips are secured within the wellbore.

2. The wellbore isolation device of claim 1, wherein the at least one first protrusion is complementary to the at least one second protrusion.

3. The wellbore isolation device of claim 1, wherein the sloped external surface of the uphole component is engageable with the sloped surface of at least one of the plurality of slips, and upon said engagement, the at least one first protrusion engages the at least one second protrusion and the plurality of slips shifts radially outward away from the central axis.

4. The wellbore isolation device of claim 1, wherein the first end of each of the plurality of slips is coupled with the downhole component of the tubular body.

5. The wellbore isolation device of claim 1, wherein the downhole component includes a first end and a second end, the first end of the downhole component slopes from the first end to the center of the downhole component providing a sloped external surface, the sloped surface of the downhole component having at least one protrusion, and the second end of the downhole component is directed downhole.

6. The wellbore isolation device of claim 5, wherein the inner surface of each of the plurality of slips is sloped from the center of each of the plurality of slips to the first end providing a second sloped surface, the second sloped surface of each of the plurality of slips having at least one second protrusion.

7. A wellbore isolation device comprising: a tubular body comprising: a downhole component having an external surface having a first inner bore formed therethrough, an uphole component having a sloped external surface having a second inner bore formed therethrough, and a sleeve extending from the uphole component and shaped to seat a ball, the sleeve having radially deformable walls; wherein the sloped external surface of the uphole component has at least one first protrusion, wherein the sleeve is shaped such that seating the ball substantially blocks fluidic communication through the first and second inner bore of the tubular body, such that the ball radially deforms the walls during the seating; a plurality of slips disposed about the external surface of the tubular body between the uphole component and the downhole component, each of the plurality of slips having a first end and a second end and comprising: an inner surface being sloped from the center of the slip to the second end of the slip providing a first sloped surface having at least one second protrusion, and an outer surface facing away from the external surface of the tubular body, the outer surface having one or more gripping protrusions, wherein the uphole component and the downhole component are separated by at least a portion of each of the plurality of slips the first sloped surface of each of the slips abuts the sloped external surface of the uphole component and the first end of each of the plurality of slips abuts the downhole component, and wherein, when engaged, the downhole component, the uphole component, and the plurality of slips are secured within the wellbore.

8. A method comprising: running a wellbore isolation device and a setting tool into a wellbore to a predetermined depth, wherein the wellbore isolation device comprises: a tubular body comprising: a downhole component having an external surface and having a first inner bore formed therethrough, and an uphole component having a sloped external surface and having a second inner bore formed therethrough, wherein the sloped external surface of the uphole component has at least one first protrusion; and a plurality of slips disposed about the external surface of the tubular body between the uphole component and the downhole component, each of the plurality of slips having a first end and a second end and comprising: an inner surface being sloped from the center of the slip to the second end of the slip providing a first sloped surface having at least one second protrusion, and an outer surface facing away from the external surface of the tubular body, the outer surface having one or more gripping protrusions, wherein the uphole component and the downhole component are separated by at least a portion of each of the plurality of slips, such that the first sloped surface of each of the slips abuts the sloped external surface of the uphole component and the first end of each of the plurality of slips abuts the downhole component; and wherein the setting tool is proximate to the tubular body; actuating the setting tool to urge the first sloped surface of each of the plurality of slips onto the sloped external surface of the uphole component, engaging the at least one first protrusion with the at least one second protrusion, and engaging the one or more gripping protrusions on the outer surface of each of the plurality of slips with the wellbore, and securing the downhole component, the uphole component, and the plurality of slips within the wellbore.

9. The method of claim 8, wherein the at least one first protrusion is complementary to the at least one second protrusion.

10. The method of claim 9, wherein the at least one first protrusion and the at least one second protrusion are ratcheted protrusions.

11. The method of claim 8, wherein the first end of each of the slips is coupled with the downhole component of the tubular body.

12. The method of claim 8, wherein the downhole component includes a first end and a second end, the first end of the downhole component slopes from the first end to the center of the downhole component providing a sloped external surface, the sloped external surface of the downhole component having at least one protrusion, and the second end of the downhole component is directed downhole.

13. The method of claim 12, wherein the inner surface of each of the plurality of slips is sloped from the center of each of the plurality of slips to the first end providing a second sloped surface, the second sloped surface of each of the plurality of slips having at least one second protrusion.

14. The method of claim 8, wherein the uphole component further comprises a sealing mechanism comprising:

a sleeve extending from the uphole component and shaped to seat a ball, the sleeve having radially deformable walls; and wherein the sleeve is shaped such that seating the ball substantially blocks fluidic communication through the tubular body, and the ball radially deforms the walls during the seating.

15. A system comprising: a wellbore isolation device comprising: a tubular body comprising: a downhole component having an external surface and having a first inner bore formed therein therethrough, and an uphole component having a sloped external surface and having a second inner bore formed therethrough, wherein the sloped external surface of the uphole component has at least one first protrusion; and a plurality of slips disposed about the external surface of the tubular body between the uphole component and the downhole component, each of the plurality of slips having a first end and a second end and comprising: an inner surface being sloped from the center of the slip to the second end of the slip providing a first sloped surface having at least one second protrusion, and an outer surface facing away from the external surface of the tubular body, the outer surface having one or more gripping protrusions, wherein the uphole component and the downhole component are separated by at least a portion of each of the plurality of slips, such that the first sloped surface of each of the slips abuts the sloped external surface of the uphole component and the first end of each of the plurality of slips abuts the downhole component; and a setting tool proximate the tubular body; and a wellbore, wherein the wellbore isolation device is disposed within the wellbore to a predetermined depth and wherein when the setting tool is actuated the downhole component, the uphole component, and the plurality of slips are secured within the wellbore.

16. The system of claim 15, wherein the at least one first protrusion is complementary to the at least one second protrusion.

17. The system of claim 15, wherein the sloped external surface of the uphole component is engageable with the first sloped surface of at least one of the plurality of slips, and upon said engagement, the at least one first protrusion engages the at least one second protrusion and each of the plurality of slips shifts radially outward away from the central axis.

18. The system of claim 15, wherein the first end of each of the plurality of slips is coupled with the downhole component of the tubular body.

19. The system of claim 15, wherein the downhole component includes a first end and a second end, the first end of the downhole component slopes from the first end to the center of the downhole component providing a sloped external surface, the sloped external surface of the downhole component having at least one protrusion, and the second end of the downhole component is directed downhole.

20. The system of claim 19, wherein the inner surface of each of the plurality of slips is sloped from the center of each of the plurality of slips to the first end providing a second sloped surface, the second sloped surface of each of the plurality of slips having at least one second protrusion.

21. The system of claim 19, wherein the uphole component further comprises a sealing mechanism comprising:

a sleeve extending from the uphole component and shaped to seat a ball, the sleeve having radially deformable walls; and wherein the sleeve is shaped such that seating the ball substantially blocks fluidic communication through the tubular body, the ball radially deforming the walls during the seating isolating a portion of the wellbore.

* * * * *